US005791886A

United States Patent [19]

Kikuchi et al.

[11] Patent Number: 5,791,886

[45] Date of Patent: Aug. 11, 1998

[54] SCROLL TYPE FLUID DISPLACEMENT APPARATUS WITH AN AXIAL SEAL PLATE

[75] Inventors: Yasuo Kikuchi, Isesaki; Yoshitaka Koitabashi, Honjo; Shigeru Ito, Isesaki, all of Japan

[73] Assignee: Sanden Corporation, Gunma, Japan

[21] Appl. No.: 733,641

[22] Filed: Oct. 17, 1996

[30] Foreign Application Priority Data

Oct. 20, 1995 [JP] Japan ..... 7-295905

[51] Int. Cl.[6] ..... F01C 1/04

[52] U.S. Cl. ..... 418/55.2; 418/178

[58] Field of Search ..... 418/55.1, 55.2, 418/55.4, 178

[56] References Cited

U.S. PATENT DOCUMENTS

| | | | |
|---|---|---|---|
| 3,986,799 | 10/1976 | McCullough | 418/56 |
| 4,487,560 | 12/1984 | Uchikawa et al. | 418/178 |
| 4,498,852 | 2/1985 | Hiraga | 418/142 |
| 4,540,355 | 9/1985 | Sakaki et al. | 418/142 |
| 4,645,436 | 2/1987 | Sakamoto | 418/142 |
| 4,890,987 | 1/1990 | Sato et al. | 418/55.1 |
| 5,122,041 | 6/1992 | Yokota et al. | 418/55.4 |

FOREIGN PATENT DOCUMENTS

| | | | |
|---|---|---|---|
| 0012615 | 6/1980 | European Pat. Off. . | |
| 0060496 | 9/1982 | European Pat. Off. . | |
| 0122722 | 10/1984 | European Pat. Off. . | |
| 38-296326 | 11/1963 | Japan . | |
| 55-35155 | 3/1980 | Japan . | |
| 56-147386 | 11/1981 | Japan . | |
| 57-148088 | 9/1982 | Japan . | |
| 58-23516 | 5/1983 | Japan . | |
| 58-192901 | 10/1983 | Japan . | |
| 58-200092 | 11/1983 | Japan . | |
| 61-171801 | 8/1986 | Japan . | |
| 63-100288 | 5/1988 | Japan | 418/178 |
| 1147181 | 6/1989 | Japan . | |
| 7139480 | 5/1995 | Japan . | |
| 2167133 | 5/1986 | United Kingdom . | |

*Primary Examiner*—John J. Vrablik
*Attorney, Agent, or Firm*—Baker & Botts, L.L.P.

[57] ABSTRACT

A scroll type fluid displacement apparatus includes a pair of scrolls having a circular end plate and a spiral element extending from an axial end surface of the circular end plate. An involute slit is formed in an involute plate. The spiral elements are inserted into the involute slit so that the involute plate and axial end plate adjoin one another. The involute slit includes an inner edge, an outer edge and an extreme line joining the inner edge with the outer edge. A first radial gap is formed between the extreme line and radial ends of the spiral element. The first radial gap is greater than a second radial gap formed between the inner and outer edges of the radial ends of the spiral element. First portions of the inner edge and outer edge are prevented from contacting the end of a spiral element even if the end of the spiral element thermally expands more than other portions of the spiral element.

11 Claims, 9 Drawing Sheets

SCROLL TYPE FLUID DISPLACEMENT APPARATUS WITH AN AXIAL SEAL PLATE

BACKGROUND OF THE INVENTION

1. Field of the Invention

The invention relates to a scroll type fluid displacement apparatus, and more particularly, to an axial seal plate for the scrolls used in a scroll type fluid compressor.

2. Description of the Prior Art

Scroll type fluid displacement apparatuses are known in the prior art. For example, U.S. Pat. No. 801,182 issued to Creux discloses a basic construction of a scroll type fluid displacement apparatus including two scroll members, each having an end plate and a spiroidal or involute spiral element extending from the end plates. The scrolls are maintained angularly and radially offset so that both spiral elements interfit to form a plurality of line contacts between their spiral curved surfaces to thereby seal off and define at least one pair of fluid pockets. The relative orbital motion of the two scrolls shifts the line contact along the spiral curved surfaces and, as a result, changes the volume in the fluid pockets. The volume of the fluid pockets increases or decreases depending on the direction of orbital motion. Thus, a scroll type fluid displacement apparatus is applicable to compress, expand or pump fluids.

In comparison with conventional piston type compressors, scroll type compressors have certain advantages, such as fewer parts and continuous compression of fluid. However, one of the problems with scroll type compressors is the difficulty in sealing the fluid pockets. Axial and radial sealing of the fluid pockets must be maintained in a scroll type compressor in order to achieve efficient operation. The fluid pockets are defined by line contacts between the interfitting spiral elements and the axial contacts between the axial end surface of one spiral element and the inner end surface of the facing plate.

With reference to FIGS. 1 and 2, one prior art sealing mechanism is shown, and includes an involute seal plate 51 made of steel having slit 151 therein. Involute seal plate 51 is disposed on an end surface of the end plate of at least one of scrolls 27 (28). Slit 151 is formed on spiral element 272 of scroll 27. Involute seal plate 51 faces the axial end surface of the spiral element of the other scroll. A gap G of constant width is formed between the radial end of the involute seal plate and the radial end of the spiral element and extends from the beginning end to the terminal end of the spiral elements.

The interfitting spiral elements, normally constructed of lightweight alloys, such as aluminum alloy, are subject to several temperature zones which are caused by the increasing pressure and decreasing volume as the fluid moves to the center of the compressor. The greatest temperature exists in the center of the compressor, as this pocket has the smallest volume and the largest pressure. This causes greater thermal expansion at the center of the spiral element than at any other portion. Since the thermal expansion coefficient of aluminum alloy is generally greater than that of steel, the aluminum will be affected more by temperature changes than steel. As the center of the spiral element expands thermally, the center of the involute seal plate is subjected to higher stresses then the outer radial portions. As a result, the center of the spiral element is subject to damage and failure.

These and other problems with prior art fluid development apparatuses are sought to be addressed by the following preferred embodiments.

SUMMARY OF THE INVENTION

It is an object the present invention to provide a fluid displacement apparatus with an axial sealing plate which prevents abnormal wear and damage to the scrolls.

It is another object of the present invention to provide a fluid displacement apparatus which has a long, useful life.

According to the present invention, a scroll type fluid displacement apparatus includes a pair of scrolls each having a circular end plate and a spiral element extending from an axial end surface of the circular end plate. The scrolls are maintained at an angular and radial offset to form a plurality of line contacts between the spiral curved surfaces, which define fluid pockets. A driving mechanism is operatively connected to one of the scrolls to effect relative orbital motion with respect to the other scroll to thereby change the volume of the fluid pockets. An involute slit is formed on an involute plate. The involute plate is disposed on an axial end surface of each circular end plate to cover the area contacted by an axial end surface of the opposite spiral element. The involute slit includes an inner edge, an outer edge, and an extreme line. A first radial gap is created between the extreme line and radial ends of the spiral element. The first radial gap is greater than a second radial gap created between the inner and outer edges and radial ends of the spiral element.

Further objects, features and other aspects of this invention will be understood from the following detailed description of the preferred embodiments of this invention with reference to the annexed drawings.

DETAILED DESCRIPTION OF THE PREFERRED EMBODIMENTS

Figure 1:
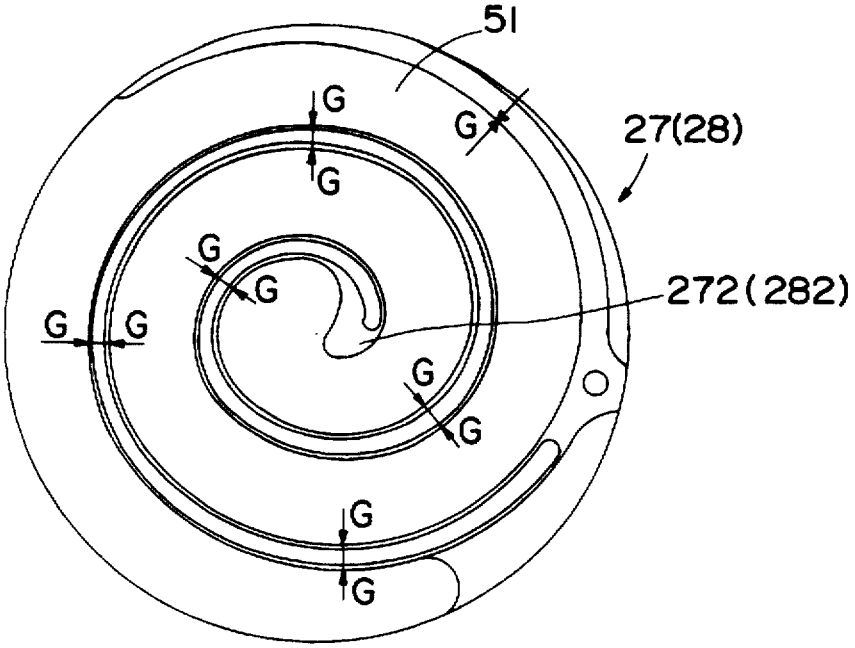
FIG. 1 PRIOR ART
FIG. 1 is a front view of a scroll of a scroll type refrigerant compressor in accordance with the prior art.
Figure 2:
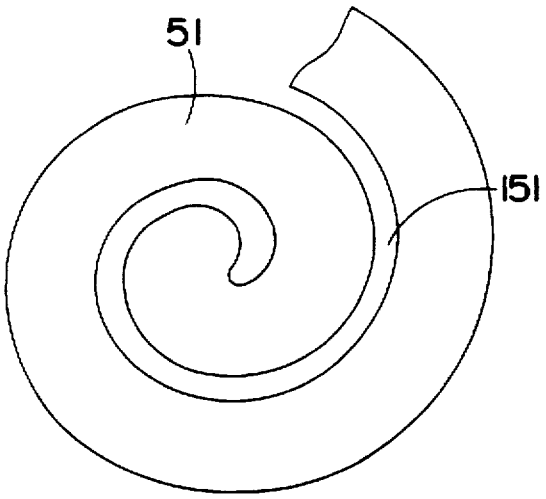
FIG. 2 PRIOR ART
FIG. 2 is a front view of an involute plate member of a scroll type refrigerant compressor in accordance with the prior art.
Figure 3:
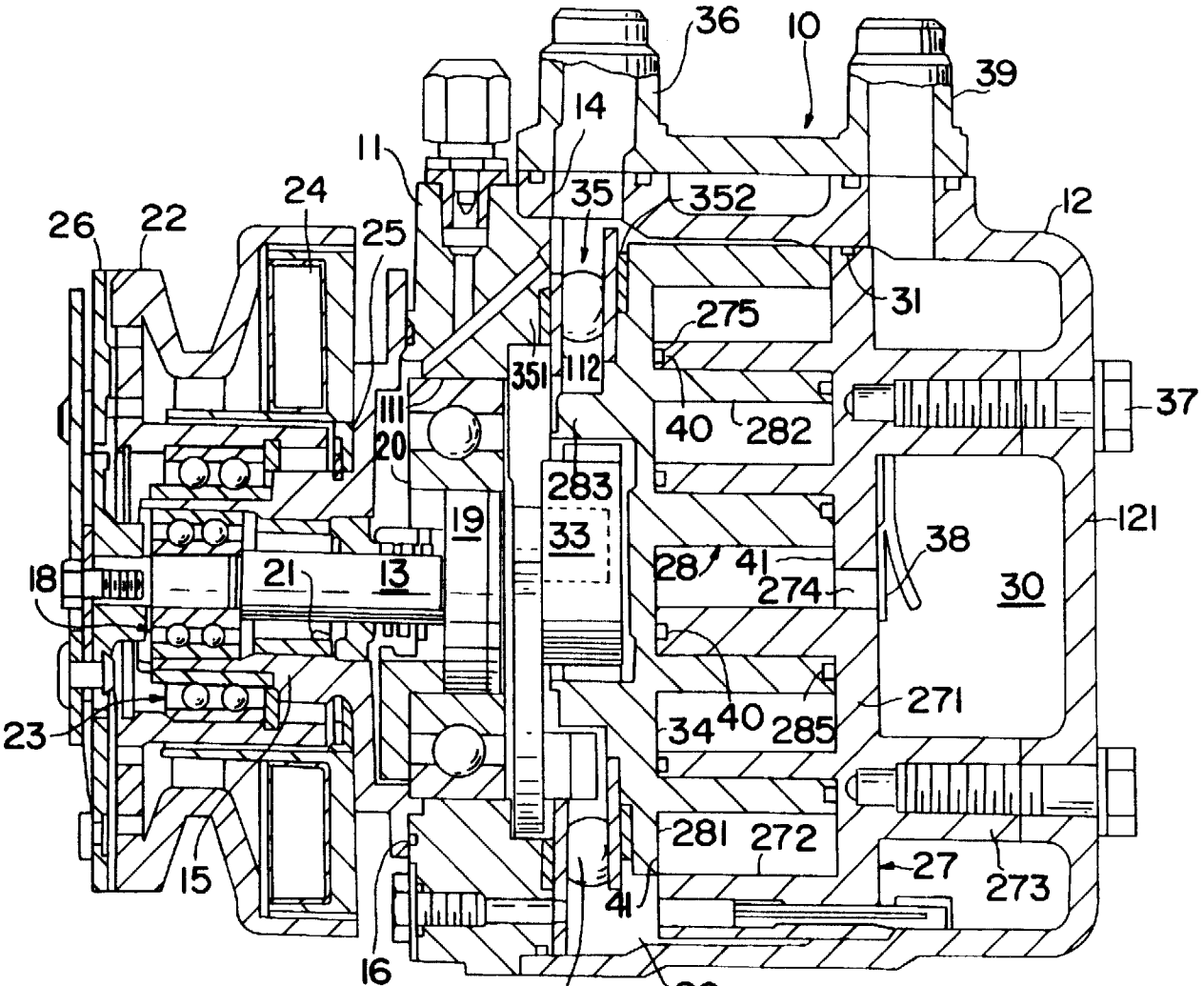
FIG. 3 is a vertical longitudinal sectional view of a scroll type refrigerant compressor in accordance with one embodiment of the present invention.

Referring to FIG. 3, a fluid displacement apparatus in accordance with the present invention is shown in the form of scroll type refrigerant compressor unit 100. Compressor unit 100 includes compressor housing 10 having front end plate 11 mounted on cup-shaped casing 12.

An opening 111 is formed in center of front end plate 11 for penetration of drive shaft 13. An annular projection 112 is formed in the rear end surface of front end plate 11. Annular projection 112 faces cup-shaped casing 12 and is concentric with opening 111. An outer peripheral surface of annular projection 112 extends into an inner wall of the opening of cup-shaped casing 12 so that the opening of cup-shaped casing 12 is covered by front end plate 11. An O-ring 14 is placed between the outer peripheral surface of annular projection 112 and the inner wall of the opening of cup-shaped casing 12 to seal the mating surface of front end plate 11 and cup-shaped casing 12.

An annular sleeve 15 projects from the front end surface of front end plate 11 to surround drive shaft 13. Annular sleeve 15 defines a shaft seal cavity. In the embodiment shown in FIG. 3, sleeve 15 is formed separately from front end plate 11. Therefore, sleeve 15 is fixed to the front end surface of front end plate 11 by screws (not shown). An O-ring 16 is placed between the end surface of front end plate 11 and an end surface of sleeve 15. Alternatively, sleeve 15 may be formed integrally with front end plate 11.

Drive shaft 13 is rotatably supported by sleeve 15 through bearing 18, which is located within the front end of sleeve 15. Drive shaft 13 has disk 19 at its inner end. Disk 19 is rotatably supported by front end plate 11 through bearing 20 located within opening 111 of front end plate 11. A shaft seal assembly 21 is coupled to drive shaft 13 within the shaft seal cavity of sleeve 15.

A pulley 22 is rotatably supported by bearing 23, which is carried on the outer surface of sleeve 15. An electromagnetic coil 24 is fixed about the outer surface of sleeve 15 by support plate 25, and is disposed within the annular cavity of pulley 22. An armature plate 26 is elastically supported on the outer end of drive shaft 13. Pulley 22, magnetic coil 24 and armature plate 26 form a magnetic clutch. In operation, drive shaft 13 is driven by an external drive power source, for example, the engine of an automobile, through a rotation transmitting device, such as a magnetic clutch.

A number of elements are located within the inner chamber of cup-shaped casing 12, including a fixed scroll 27, an orbiting scroll 28, a driving mechanism for orbiting scroll 28 and a rotation preventing/thrust bearing device 35 for orbiting scroll 28. The inner chamber of cup-shaped casing 12 is formed between the inner wall of cup-shaped casing 12 and the rear end surface of front end plate 11.

Fixed scroll 27 includes circular end plate 271, a wrap or spiral element 272 affixed to or extending from one side surface of circular end plate 271, and internally threaded bosses 273 axially projecting from the other end surface of circular plate 271. An axial end surface of each boss 273 is seated on the inner surface of bottom plate portion 121 of cup-shaped casing 12 and fixed by screws 37 screwed into bosses 273. Thus, fixed scroll 27 is fixed within the inner chamber of cup-shaped casing 12. Circular plate 271 of fixed scroll 27 partitions the inner chamber of cup-shaped casing 12 into a front chamber 29 and rear chamber 30. A seal ring 31 is disposed within a circumferential groove of circular end plate 271 to form a seal between the inner wall of cup-shaped casing 12 and the outer surface of circular end plate 271. Spiral element 272 of fixed scroll 27 is located within front chamber 29.

Cup-shaped casing 12 is provided with a fluid inlet port 36 and fluid outlet port 39, which are connected to front and rear chambers 29 and 30, respectively. A discharge port 274 is formed through circular plate 271 near the center of spiral element 272. A reed valve 38 closes discharge port 274.

Orbiting scroll 28, which is located in front chamber 29, includes a circular end plate 281 and a wrap or spiral element 282 not labeled in affixed to or extending from one side surface of circular end plate 281. Spiral elements 272 and 282 interfit at an angular offset of 180 degrees and a predetermined radial offset. Spiral elements 272 and 282 define at least one pair of sealed off fluid pockets between their interfitting surfaces. Orbiting scroll 28 is rotatably supported by bushing 33 through bearing 34 placed between the outer peripheral surface of bushing 33 and the inner surface of annular boss 283 axially projecting from the end surface of circular end plate 281 of orbiting scroll 28. Bushing 33 is connected to an inner end of disk 19 at a point radially offset or eccentric with respect to drive shaft 13.

Rotation preventing/thrust bearing device 35 is disposed between the inner end surface of front end plate 11 and the end surface of circular end plate 281. Rotation preventing/thrust bearing device 35 includes fixed ring 351 attached to the inner end surface of front end plate 11, orbiting ring 352 attached to the end surface of circular end plate 281, and a plurality of bearing elements, such as balls 353, placed between the pockets formed by rings 351 and 352. The axial thrust load from orbiting scroll 28 also is supported on front end plate 11 through balls 353.

Spiral elements 272 and 282 include grooves 275 and 285 on the axial end surfaces thereof Seal element 40 is disposed in the grooves to the mating surfaces seal against each circular end plate 271 and 281. Involute plate 41, which is formed of a hard metal, such as hardened steel, is fitted to the end surface of both end plates 271 and 281 to minimize the abrasion and reduce the wear of the scrolls.

Figure 4:
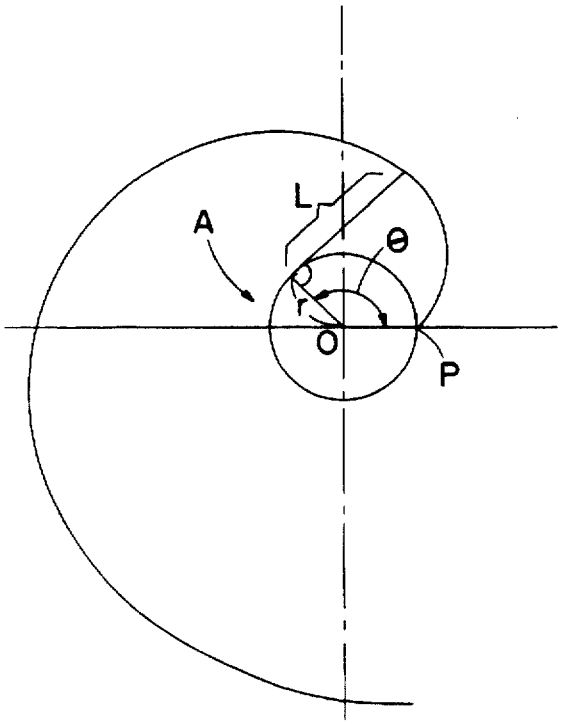
FIG. 4 is a diagram illustrating the properties of an involute of a circle.
Figure 5:
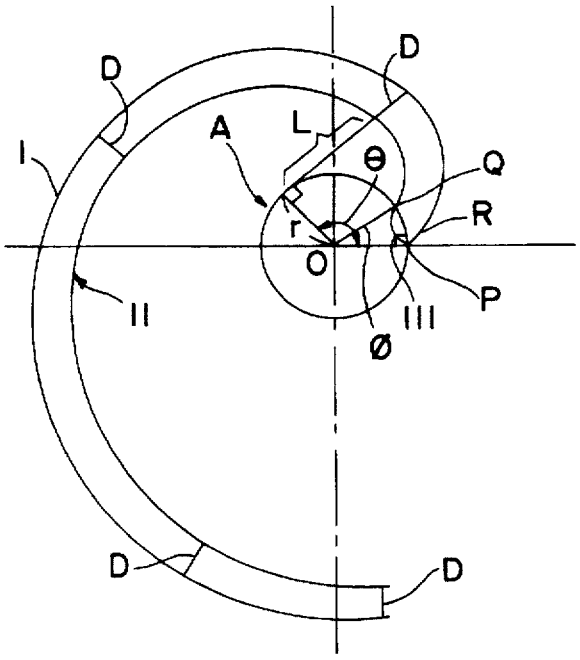
FIG. 5 is a diagram of two involutes illustrating the basic properties of an involute wrap of a scroll.

Generally, the side wall of the spiral element of a scroll follows an involute of a circle such as FIG. 4. This involute is formed by beginning at starting point P of the generating circle A and tracing the involute from the end of an extensible string unwinding from point P. The curvature of the involute, i.e., the length L along a tangent from generating circle A to the intersection of the involute, is given by $L=\theta\cdot r$, where $\theta$ is the involute angle, and r is the radius of generating circle A. FIG. 5 illustrates two involutes, one involute, I, starts at point P on the generating circle A, and the other involute, II, start at point Q on generating circle A. Point Q is located at angular offset of $\phi$ from point P. Since length L along the tangent from generating circle A to the intersection of involute I is given by $L=\theta\cdot r$, and length M along the tangent from generating circle A to the intersection of involute II is given by $M=(\theta-\phi)\cdot r$, the distance D between both involutes I and II is given by $L-M=\theta\cdot r-(\theta-\phi)\cdot r=\phi\cdot r$. Thus, the distance between involutes I and II is uniform and is not influenced by the involute angle at which the distance is measured. Further, the beginning wall of the spiral element of scroll includes a curve, III, which is substantially streamline-shaped and links point Q with point R so as to be convex toward center O of generating circle A. Point R lies on the involute in the vicinity of point P, but not exactly on point P.

Figure 6:
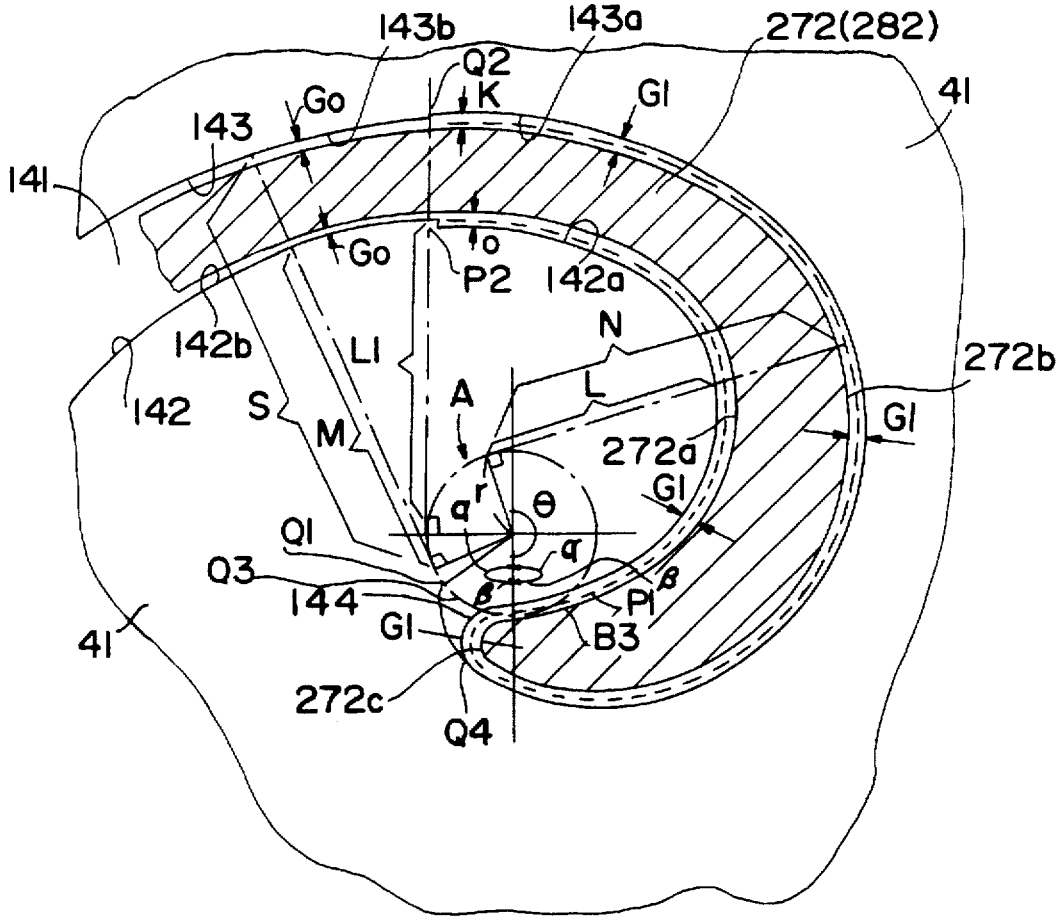
FIG. 6 is an enlarged partial view of a part of a spiral element of a scroll compressor illustrating the configuration of an involute plate member in accordance with a first embodiment of the present invention.

Referring to FIG. 6, involute plate 41 includes slit 141 which has inner edge 142, outer edge 143 and extreme line 144 linking inner edge 142 with outer edge 143. Slit 141 is shaped similar to the side walls of spiral elements 272 (282) in order to insert plate 41 over spiral elements 272 (282). Slit 141 is designed to be broader in width than spiral elements 272 (282). Gaps G1 are created between inner edge 142 and inside wall 272*a* of spiral element 272 (282), and between outer edge 143 and outside wall 272*b* of spiral element 272 (282). Inner edge 142 and outer edge 143 include first involutes 142*a* and 143*a* and second involutes 142*b* and 143*b*.

First involute 142*a* of inner edge 142 is formed by beginning at starting point $P_1$ of a generating circle A and tracing the involute from the end of an extensible string unwinding from point $P_1$. The curvature of the involute, i.e., the length L along a tangent from generating circle A to the intersection of first involute 142*a*, is given by $L=(\theta-\alpha)\cdot r$, where $\alpha$ is the design phase angle similar to the configuration of spiral element 272. First involute 142*a* preferably joins second involute 142*b* at point $P_2$ where length L of first involute 142*a* is equal to $L_1$, given by $L_1=(3\pi/2-\alpha)\cdot r$. At any point on first involute 142*a* when length L is smaller than $L_2$, $L_2=2\pi r$ (when first involute 142*a* is formed with one turn). Second involute 142*b* begins at point $P_2$, tracing the involute from the end of an extensible string unwinding from point $P_3$ and continuing to the end of involute plate 41. Point $P_3$ is located at angular offset of $(\alpha-\beta)$ from point $P_1$. Length M along the tangent from generating circle A to the intersection of second involute 142*b* is given by $M=(\theta-\beta)\cdot r$. Distance D between both involutes 142*a* and 142*b* is given by $M-L=(\theta-\beta)\cdot r-(\theta-\alpha)\cdot r=(\alpha-\beta)\cdot r$=a constant.

Similarly, first involute 143*a* of outer edge 143 begins at starting point $Q_4$ from the end of an extensible string unwinding from point $Q_1$of generating circle A. The curvature of the involute, i.e., a length N along a tangent from generating circle A to the intersection of first involute 143*a*, is given by $N=(\theta-\alpha)\cdot r$, where $\alpha$ is the design phase angle. First involute 143*a* preferably joins second involute 143*b* at point $Q_2$. Second involute 143*b* is formed by beginning at $Q_2$ and tracing the involute from the end of an extensible string unwinding from point $Q_3$ of generating circle A and continuing to the end of involute plate 41. Point $Q_3$ is located at angular offset of $(\alpha-\beta)$ from point $Q_1$. Length S along the tangent from the generating circle to the intersection of second involute 143*b* is given by $S=(\theta+\beta)\cdot r$. Distance K between both involutes 143*a* and 143*b* is given by $N-S=(\theta+\alpha)\cdot r-(\theta+\beta)\cdot r=(\alpha-\beta)\cdot r$=a constant.

Extreme line 144 of slit 141 of involute plate 41 is preferably a streamline-shaped curve, which is similar in shape to the beginning of end wall 272*c* of spiral element 272 (282). Extreme line 144 links point $P_1$with point $Q_4$ and is convex toward center O of generating circle A. Point $Q_4$ lies on first involute 143*a* in the vicinity of point $Q_1$.

Gap $G_1$ is created between the inner edge 142 of the first involute 142*a* and the inside wall 272*a* of spiral element 272, between the outer edge 143 of first involute 143*a* and the outside wall 272*b* of spiral element 272, and between extreme line 144 and spiral element 272 (282). Gap $G_0$ is created between second involute 142*b* of inner edge 142 and inside wall 272*a* of spiral element 272, and between second involute 143*b* of outer edge 143 and outside wall 272*b* of spiral element 272. Gap $G_1$ is greater than gap $G_0$ by D (or $K)=(\alpha-\beta)\cdot r$=a constant.

In the above arrangement of scroll type refrigerant compressor, fluid from the external fluid circuit is introduced into fluid pockets in the compressor unit through inlet port 36. As orbiting scroll 282 orbits, the fluid in the fluid pockets moves to the center of the spiral elements and is compressed. The compressed fluid is discharged into rear chamber 30 through discharge hole 274. The compressed fluid then is discharged to the external fluid circuit through outlet port 39.

First involute 142*a* of inner edge 142 and first involute 143*a* of outer edge 143 of involute plate 41 are sized to avoid contact with wall 272*c* of spiral element 272 (282) even if wall 272*c* thermally expands.

As a result, wall 272*c* of spiral element 272 (282) is better protected against damage or fatigue failure.

Figure 7:
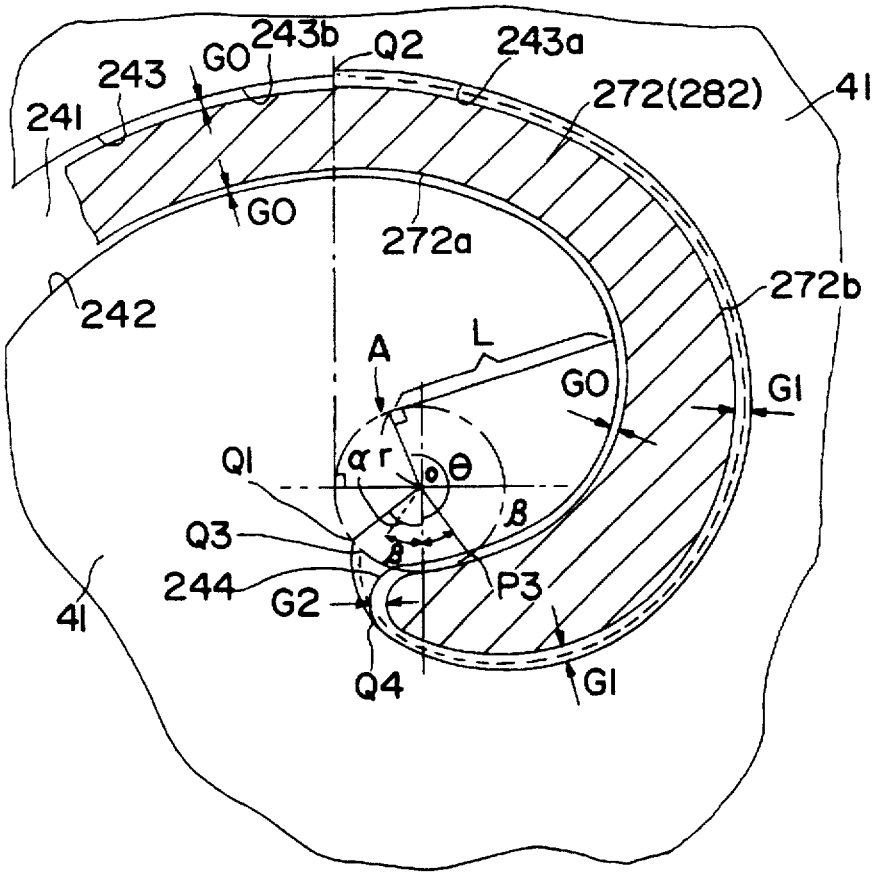
FIG. 7 is an enlarged partial view of a part of a spiral element of a scroll compressor illustrating the configuration of an involute plate member in accordance with a second embodiment of the present invention.

Referring to FIG. 7, a second embodiment of the present invention is shown which is directed to a modified configuration of involute plate 41. This involute plate is similar to involute plate 41 described above. However, some differences do exist as follows.

Involute plate 41 includes slit 241 which has inner edge 242, outer edge 243 and extreme line 244 linking inner edge 242 with outer edge 243. Inner edge 242 begins at point $P_3$ of circle A and is formed by tracing the involute from the end of an extensible string unwinding from point $P_3$. The curvature of the involute, i.e., a length L along a tangent from generating circle A to the intersection of inner edge 242, is given by $L=(\theta-\beta)\cdot r$, where $\beta$ is the design phase angle. The description of outer edge 243 is omitted because it is substantially identical to the first embodiment.

Extreme line 244 of slit 241 preferably has a streamline-shaped curve, which is similar in shape to end wall 272*c* of spiral element 272 (282). Extreme line 244 links point $P_3$ with point $Q_4$ toward center 0 of generating circle A. Point $Q_4$ lies on first involute 243*a* in the vicinity of point $Q_1$.

Gap $G_1$ is created between first involute 243*a* of outer edge 243 and outside wall 272*b* of spiral element 272. Gap $G_0$ is created between inner edge 242 and inside wall 272*a* of spiral element 272. Gap $G_2$ is created between extreme line 244 and end wall 272*c* of spiral element 272 (282). The size of gap $G_2$ changes to $G_1$ at $Q_4$ and to $G_0$ at $P_3$. Gap $G_1$ is larger than gap $G_2$ by D (or $K)=(\alpha-\beta)\cdot r$=a constant.

Substantially the same advantages are realized in the first and second preferred embodiments, so details of the advantages are not repeated.

Figure 8:
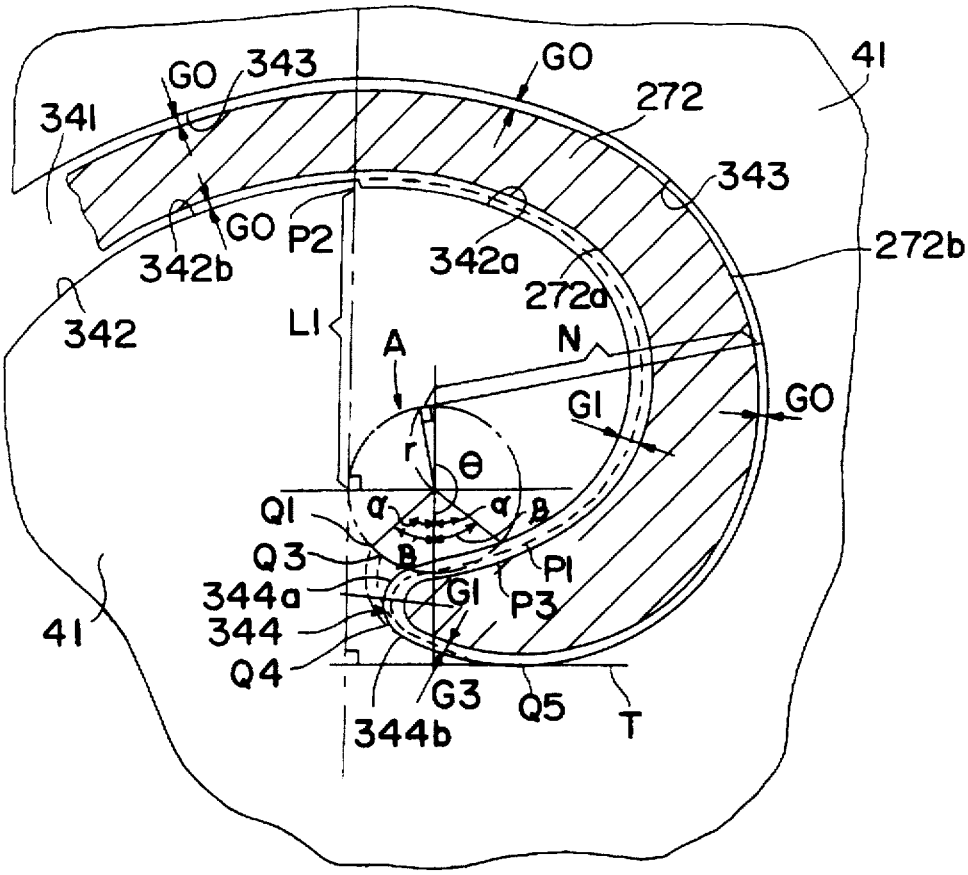
FIG. 8 is an enlarged partial view of a part of a spiral element of a scroll compressor illustrating the configuration of an involute plate member in accordance with a third embodiment of the present invention.

Referring to FIG. 8, a third embodiment of the present invention is shown which is directed to a modified configuration of involute plate 41. This involute plate is similar to involute plate 41 described above. However, some differences do exist as follows.

Involute plate 41 includes slit 341 which has inner edge 342, outer edge 343 and extreme line 344 linking inner edge 342 with outer edge 343. The description of inner edge 342 is omitted, since it is substantially identical to that of the first embodiment. Outer edge 343 begins at point $Q_5$ and is formed by tracing the involute from the end of an extensible string unwinding from point $Q_3$ on circle A. Point $Q_5$ is defined by the point at which length T is tangent to outer edge 343. Line T is perpendicular to line $L_1$. The curvature of the involute, i.e., length N along a tangent from generating circle A to the intersection of outer edge 343, is given by $N=(\theta-\beta)\cdot r$, where P is the design phase angle. Further, extreme line 344 of slit 341 is preferably a streamline-shaped curve, which is similar in shape to end wall 272*c* of spiral element 272 (282). Extreme line 344 includes first line 344*a* linking point $P_1$ with point $Q_4$ and second line 344*b* linking point $Q_4$ with $Q_5$. Point $Q_4$ lies on first involute 342*a* in the vicinity of point $Q_1$.

Gap $G_1$ is created between the first involute 342*a* and inside wall 272*a* of spiral element 272 and between first line 344*a* of extreme line 344 and end wall 272*c*. Gap $G_0$ is created between second involute 342*b* and inside wall 272*a* of spiral element 272. Gap $G_3$ is created between second line 344*b* of extreme line 344 and end wall 272*c* of spiral element 272 (282). The size of gap $G_3$ changes to $G_1$ at $Q_4$ and to $G_0$at $Q_5$. Gap $G_1$ is larger than gap $G_0$ by D (or $K)=(\alpha-\beta)\cdot r$=a constant.

Substantially the same effects and advantages as those in the first embodiment are realized, so the details are not repeated.

Figure 9:
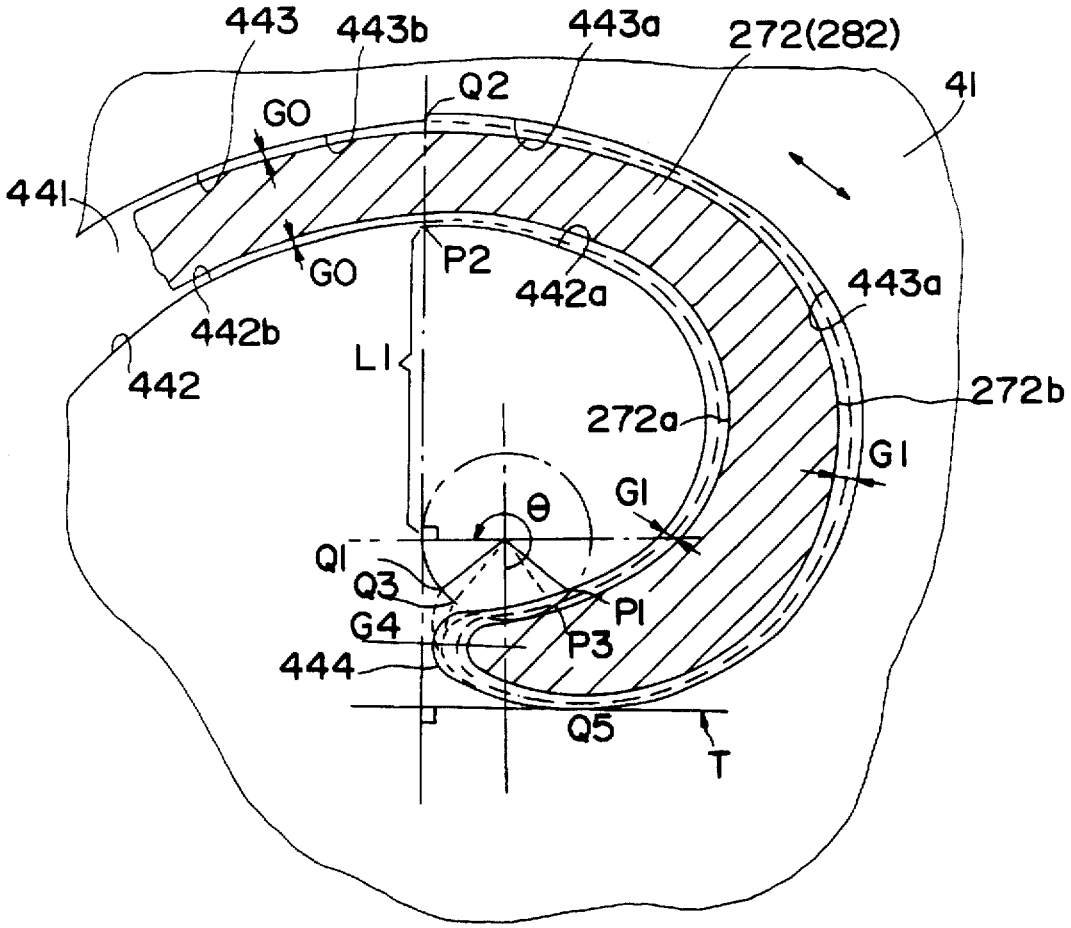
FIG. 9 is an enlarged partial view of a part of a spiral element of a scroll compressor illustrating the configuration of an involute plate member in accordance with a fourth embodiment of the present invention.

Referring to FIG. 9, a fourth embodiment of the present invention is shown which is directed to a modified configuration of involute plate 41. This involute plate is similar to involute plate 41 described above. However, some differences do exist as follows.

Extreme line 444 links point $P_1$ with point $Q_5$ and is convex toward center O of generating circle A. Point $Q_5$ is defined by the point where line T is tangent to first involute 443*a* of outer edge 443. Line T is perpendicular to length $L_1$.

Gap $G_4$ is created between extreme line 444 and end wall 272*c* of spiral element 272 (282). Gap $G_4$ is larger than $G_1$.

Substantially the same effects and advantages as those in the first embodiment can be obtained. In addition, in the fourth embodiment, involute plate 41 rotates in the direction of arrow. Scroll 28 temporally rotates together with involute plate 41, when the compressor is started. Extreme line 444 of slit 441 does not contact the edge portion of beginning wall 272*c*. However, second involutes 442*b* and 443*b* contact the inside wall 272*a* or outside wall 272*b*. As a result, first involute 442*a* or first involute 443*a* are prevented from striking inside wall 272*a*, outside wall 272*b*, or the beginning end wall 272*c*, even if caused by the rotation of involute plate 41.

Figure 10:
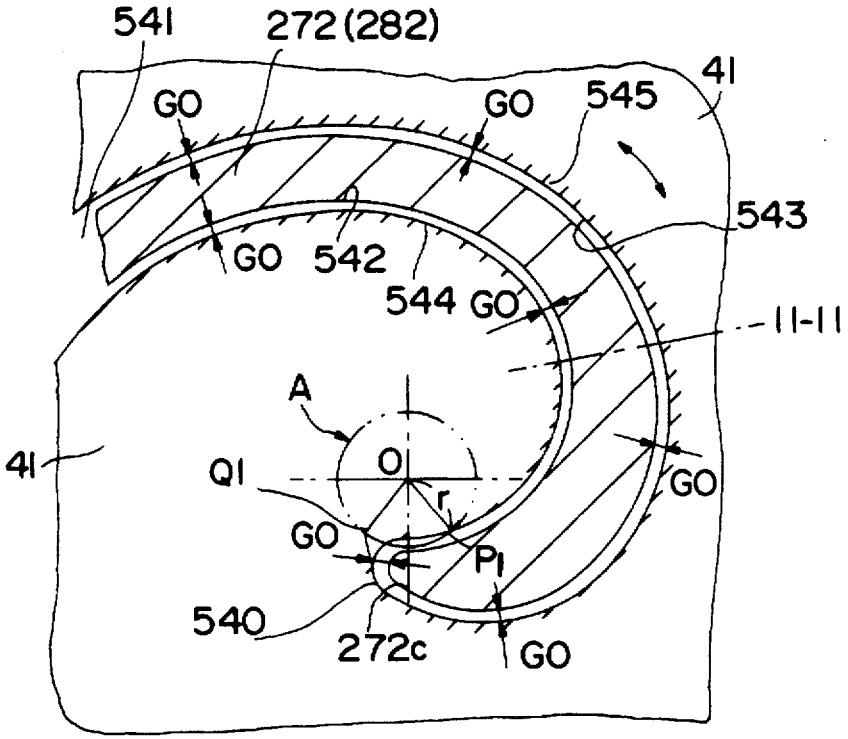
FIG. 10 is an enlarged partial view of a part of a spiral element of a scroll compressor illustrating the configuration of an involute plate member in accordance with a fifth embodiment of the present invention.
Figure 11A:
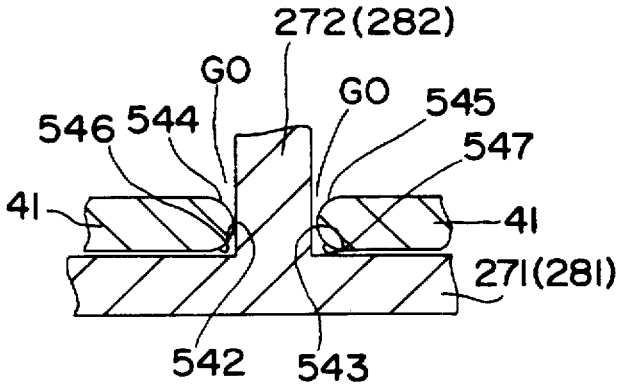
FIG. 11*a* is an enlarged partial sectional view taken along line 11—11 of FIG. 10.
Figure 11B:
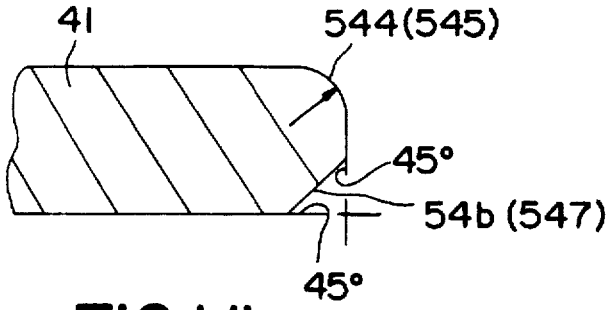
FIG. 11*b* is an enlarged, partial sectional view of an involute plate illustrating curved portions and chamfer-cut protions, as depicted in FIG. 11*a*.

Referring to FIGS. 10 and 11*a–b*, a fifth embodiment of the present invention is shown which is directed to a modified configuration of involute plate 41. This involute plate is similar to involute plate 41 described above. However, some differences do exist as follows.

Involute plate 41 includes slit 541 which has inner edge 542, outer edge 543 and extreme line 540 linking inner edge 542 with outer edge 543. Gap $G_0$ is created between inner edge 542 and inside wall 272*a* of spiral element 272, between outer edge 543 and outside wall 272*b* of spiral element 272, and between extreme line 540 and beginning end wall of spiral element 272.

In the production of involute plate 41, slit 541 is formed by punching. This production process naturally produces beveled curved portions 544 and 545 and Chamfer-cut portions 546 and 547. Referring to FIG. 11*b*, the punching process that forms slit 541 of involute plate 41 may form the rounded shape of curved portion 544 and 545 at upper portions of outer edges 543 of involute plate 41. Chamfer-cut portions 546 and 547 may be formed, for example, about a 45° angle, with respect to the bottom surface and outer edge 543 of involute plate 41.

Therefore, even if beginning end wall 272*c* of spiral element 272 has greater thermal expansion than the other portions of spiral element 272 and interfits with inner edge 542, outer edge 543, or extreme line 544, inner edge 542, outer edge 543, and extreme line 544 do not interfere with end wall 272*c* of spiral element 272. As a result, end wall 272*c* of spiral element 272 (282) is better protected against damage and fatigue failure.

Although the present invention has been described in connection with the preferred embodiments, the invention is not limited thereto. It will be understood by those of ordinary skill in the art that variations and modifications can be easily made within the scope of this invention as defmed by the appended claims.

What is claimed is:

1. A scroll type fluid displacement apparatus comprising:

a pair of scrolls, each said scroll having a circular end plate and a spiral element extending from an axial end surface of said circular end plate, said pair of scrolls maintained at an angular and radial offset to make a plurality of line contacts which define a plurality of fluid pockets;

a driving mechanism operatingly connected to one of said scrolls to effect relative orbital motion with respect to the other of said scrolls to thereby change the volume of said fluid pockets;

an involute plate including an involute slit formed therein, said spiral elements inserted into said involute slit, said involute plate disposed on an axial end surface of each of said circular end plates of said scrolls to cover the area on which contact is made by an axial end surface of an opposite spiral element, said involute slit including an inner edge, an outer edge and an extreme line joining said inner edge with said outer edge, comprising:

a first radial gap formed between said extreme line and radial ends of said spiral element, said first radial gap greater than a second radial gap formed between said inner and outer edges and radial ends of said spiral element, wherein said involute slit has a shape similar to the radial ends of said spiral element.

2. The scroll type fluid displacement apparatus recited in claim 1, wherein said involute slit includes a beveled surface formed on at least one edge thereof.

3. The scroll type fluid displacement apparatus recited in claim 2, wherein said beveled surface of said involute slit is located near an axial end of said circular end plate of said scroll.

4. The scroll type fluid displacement apparatus recited in claim 2, wherein said beveled surface of said involute slit is formed on said extreme line.

5. A scroll type fluid displacement apparatus comprising:

a pair of scrolls, each having a circular end plate and a spiral element extending from an axial end surface of said circular end plate, said pair of scrolls maintained at an angular and radial offset to make a plurality of line contacts which define a plurality of fluid pockets;

a driving mechanism operatingly connected to one of said scrolls to effect relative orbital motion with respect to the other of said scrolls to thereby change the volume of said fluid pockets;

an involute plate including an involute slit formed therein, said spiral elements inserted into said involute slit, said involute plate disposed on an axial end surface of each of said circular end plates of said scrolls to cover the area on which contact is made by an axial end surface of an opposite spiral element, said involute slit including an inner edge, an outer edge and an extreme line joining said inner edge with said outer edge, said inner edge and said outer edge respectively including first portions extending from radial ends of said extreme line and second portions extending from said first portions, comprising:

a first radial gap formed between said first portions of said inner and outer edges of said involute slit and radial ends of said spiral element, and a second radial gap formed between said extreme line of said involute slit and radial ends of said spiral element, both of said first and second radial gaps larger than a third radial gap formed between said second portions of said inner and outer edges of said involute slit and radial ends of said spiral element.

6. The scroll type fluid displacement apparatus recited in claim 5, wherein said involute slit has a shape similar to the radial ends of said spiral element.

7. The scroll type fluid displacement apparatus recited in claim 5, wherein each of said first portions of said inner edge and outer edge is respectively formed by tracing an involute of a generating circle with an end of an extensible string, said first portions of said inner edge and outer edge joining said second portions where length L, along a tangent from said generating circle an intersection of said first portion, is $L_1=2\pi\cdot r$, where r is a radius of said generating circle.

8. The scroll type fluid displacement apparatus recited in claim 5, wherein said second radial gap is larger than said first radial gap.

9. The scroll type fluid displacement apparatus recited in claim 5, wherein said involute slit includes a beveled surface formed on at least one edge thereof.

10. The scroll type fluid displacement apparatus recited in claim 9, wherein said beveled surface is located near an axial end of said circular end plate of said scroll.

11. The scroll type fluid displacement apparatus recited in claim 9, wherein said beveled surface of said involute slit is formed on said first portion of said inner and outer edges and said extreme line of said involute slit.

* * * * *